US006881972B2

(12) United States Patent
Butikofer et al.

(10) Patent No.: US 6,881,972 B2
(45) Date of Patent: Apr. 19, 2005

(54) MEDIA STIFFNESS DETECTION DEVICE AND METHOD THEREFOR

(75) Inventors: Chet Butikofer, Meridian, ID (US); Robert Jewell, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 213 days.

(21) Appl. No.: 10/288,356

(22) Filed: Nov. 4, 2002

(65) Prior Publication Data

US 2004/0084643 A1 May 6, 2004

(51) Int. Cl.[7] ..... G01N 21/86; G01V 8/00

(52) U.S. Cl. ..... 250/559.29; 271/258.01; 271/259; 271/265.01; 271/265.02; 73/849; 73/862.041

(58) Field of Search ..... 250/559.29; 271/258.01, 271/259, 265.01, 265.02; 73/849, 862.041

(56) References Cited

U.S. PATENT DOCUMENTS

| | | | | |
|---|---|---|---|---|
| 4,365,151 A | | 12/1982 | Fasig et al. | |
| 4,484,070 A | | 11/1984 | Inoue | |
| 4,614,867 A | | 9/1986 | Lane | |
| 4,985,636 A | | 1/1991 | Fukui et al. | |
| 5,053,616 A | | 10/1991 | Trett | |
| 5,075,543 A | | 12/1991 | Courtney | |
| 5,201,424 A | * | 4/1993 | Hain | 209/534 |
| 5,371,353 A | | 12/1994 | Shibuya | |
| 5,466,079 A | | 11/1995 | Quintana | |
| 5,564,848 A | | 10/1996 | Quintana | |
| 5,775,690 A | * | 7/1998 | Quesnel et al. | 271/242 |
| 5,934,140 A | * | 8/1999 | Jackson et al. | 73/159 |
| 6,364,556 B1 | | 4/2002 | Barbera et al. | |
| 6,701,098 B1 | * | 3/2004 | Pyke et al. | 399/45 |
| 2003/0042443 A1 | * | 3/2003 | Pechan et al. | 250/559.45 |
| 2004/0046315 A1 | * | 3/2004 | Jewell | 271/262 |

* cited by examiner

*Primary Examiner*—David Porta
*Assistant Examiner*—Davienne Monbleau

(57) ABSTRACT

A media processing system retrieves a sheet of media and transports it to an imaging process. Misalignment of media from retrieving and transporting is removed by a media realignment process which wedges the leading edge of the media into stopped rollers while additionally advancing the trailing edge of the media for a predetermined distance. The media flexes and forms an arching buckle which aligns parallel to the leading edge of the media with the stopped rollers, thereby removing the skew of the media in relationship with the stopped rollers. The amount of over-advancement of the trailing edge of the media is modified according to the stiffness of the media. A media stiffness sensor measures the media stiffness by quantifying the deflection of the media when a portion of the media is cantilevered into deflection-measuring sensors. Imaging processes are also improved by employing media stiffness measurements to modify imaging processes.

20 Claims, 6 Drawing Sheets

56

| MEDIA CHARACTERISTIC LOOK UP TABLE | | | |
|---|---|---|---|
| STIFFNESS DEGREE | MEDIA MAKE | MEDIA FINISH | PROCESSING ADJUSTMENT SETTINGS |
| 1 | ABC | HARD | X, Y, Z |
| ⋮ | ⋮ | ⋮ | ⋮ |
| N | | | |

MEDIA STIFFNESS DETECTION DEVICE AND METHOD THEREFOR

BACKGROUND OF THE INVENTION

1. Field of the Invention

The present invention relates generally to analysis of print media in document processing devices. More particularly, the present invention relates to the identification of a print media characteristic, namely a media stiffness characteristic.

2. State of the Art

A media transport system transports media through a media processing system such as a printer, photocopier, scanner, fax, or other image device. In a media transport system, a media entity such as a sheet is picked from a stack or tray and moved through a media path using one or more sets of rollers, channels or pathways. The media is then positioned and placed in alignment with an imaging system of the media processing system for either imprinting of an image to the media or the evaluation of an image already resident upon the media, depending upon the functionality associated with the media processing system. For an optimal imaging process to occur, it is desirable for the media to be properly aligned with respect to the imaging system.

Several factors may contribute to the misalignment of the media in the media path. One source of misalignment occurs during a media picking phase wherein a piece of media such as a sheet is picked from a stack of media and begins conveyance down a media path in a skewed or misaligned manner. Initially, media is typically removed from a media stack or tray using a set of rollers known as pick rollers. Pick rollers exert forces upon the media for both separating the media from adjacent media and for directing the media into the media path. Because of unpredictable frictional forces as well as misalignment associated with a stack or tray of media, the media generally enters the media path in a skewed orientation.

One approach for removing a majority of skew from media once in the paper path utilizes a concept known as media buckling. In a media buckling process, a roller assembly, such as pick rollers or other media path rollers, exerts a driving force which causes a buckle or arching of the media as the leading edge of the media encounters either a subsequent set of stopped rollers, such as registration rollers, or some other blockage that prevents the leading edge of the media from continuing down the media path. Once the initial or leading edge of the media has been stopped and force continues to be applied to the trailing edge, a buckling or arching of the media occurs which results in an asymmetric arching of the media allowing the leading edge to square-up with the blocking orientation device at the leading edge of the media.

Prior attempts at controlling the buckling process have been met with varying degrees of success. Some attempts utilize a one-size-fits-all approach for generation of a media buckle. However, those of skill in the art appreciate that buckling profiles are a function of the stiffness of the media being processed. Prior attempts at removing skew from stiff media by using the buckling process have resulted in the wedging and undesirable over-advancement of the stiff media into the stopped rollers rather than the formation of a skew-removing buckling profile. Therefore, for at least stiff media, additional skew is injected into the media path due to wedging of the stiffer media into stopped registration rollers resulting in an undesirable advancement of the media along the media path. This wedging of stiff media into the stopped registration rollers results not only in media damage but in misalignment of the media in the paper path, thereby causing misalignment of other processes on the media at subsequent stages in the media path. Accordingly, there is a need for another approach for handling skew across a broad spectrum of media stiffnesses.

BRIEF SUMMARY OF THE INVENTION

According to the present invention, media processing devices exhibit improved performance if the stiffness of the media is determined, thereby allowing for adaptations of processes, including adaptation of media transport processes and imaging processes. During the media transport phase, the media transport system picks a piece of media from media storage. Due to the existing tolerance in the media orientation and variations in forces associated with the media picking process, as well as other factors, the media would otherwise arrive at the imaging process in an unacceptably skewed orientation. Such skew is minimized by analysis of the stiffness of the media and tailoring of the media alignment processes according to the derived media stiffness information. Additional imaging processes may accordingly be modified in response to the derived stiffness characteristic of the media.

According to one aspect of the invention, media sensors are disposed in the media transport path and are located on one side of a cantilever pivot, also in the media path. The picked media is placed across the cantilevered pivot such that a determined length of the media is allowed to unsupportedly extend from the cantilevered pivot into a region monitored by the media sensors and to freely deflect according to the inherent stiffness of the media under the weight of that portion of media. Various embodiments for cantilevering media are presented.

The sensors measure an amount of deflection of the media for calculating and processing into a corresponding media stiffness measurement. According to one embodiment of the present invention, the media stiffness measurement is derived from indexing a lookup table which correlates media deflection measurements into media stiffness measurements and further into corresponding process adjustments. According to another embodiment of the present invention, multiple deflection measurements may be taken with different lengths of the media cantilevering into the sensors. These multiple deflection measurements are used to correlate respective media stiffness measurements.

According to another aspect of the invention, the media realignment process is modified or adjusted according to identified stiffness of the media. In one embodiment, the media alignment process includes advancing the media using a set of trailing rollers with the leading edge of the media encountering a pair of stopped registration rollers. The trailing edge of the media is further advanced while the leading edge remains stopped. The asymmetric advancement of the leading and trailing edges creates a bulging or buckling of the media. The buckling profile of the media facilitates the removal of media misalignment skew through the parallel alignment of the leading edge with the nip of the registration rollers. The amount of over-advancement of the trailing edge is controlled according to the derived media stiffness measurement. By tailoring the buckling skew-removal profile according to the media stiffness, the removal of media skew may be maximized. According to another aspect of the invention, the media stiffness measurements are also used to modify imaging processes.

DETAILED DESCRIPTION OF THE INVENTION

Figure 1:
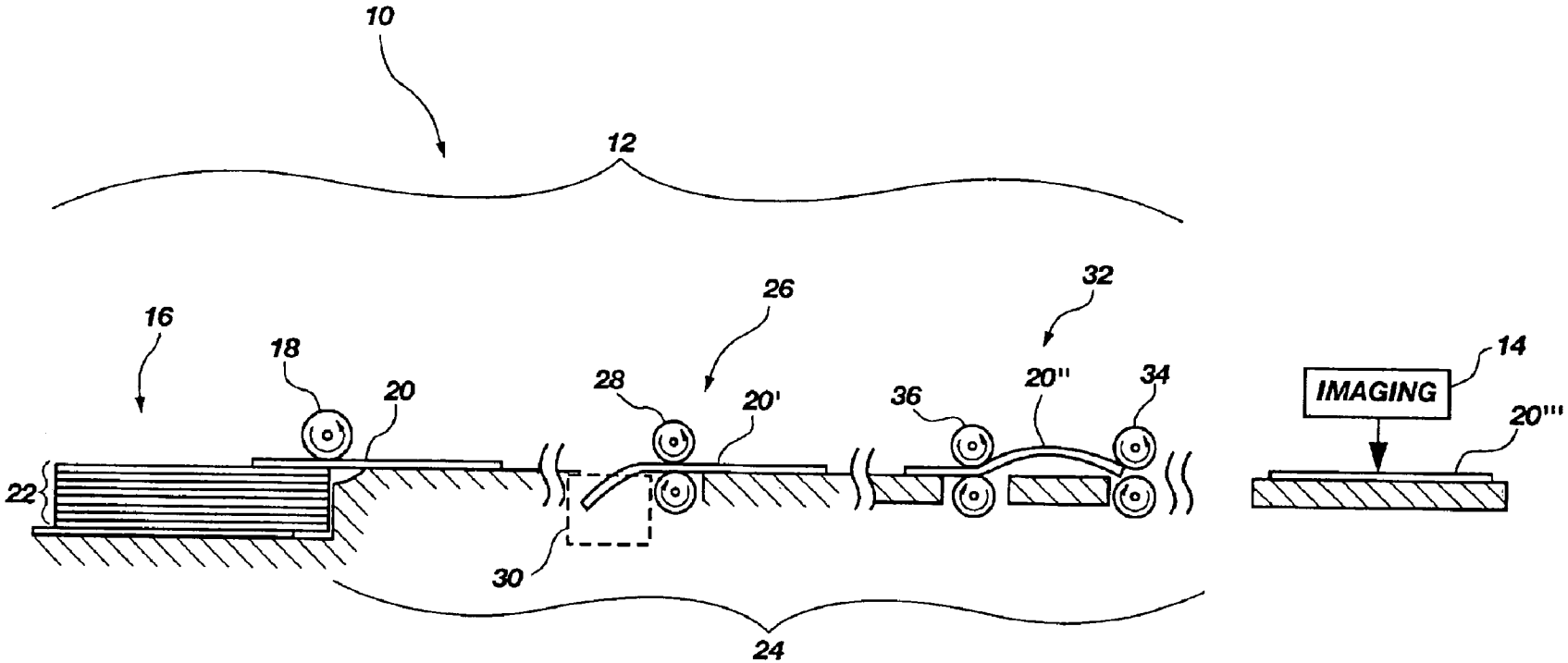
FIG. 1 illustrates a media processing system wherein an embodiment of the present invention may be implemented.

FIG. 1 illustrates a process flow within a media processing system 10, according to one embodiment of the present invention. It should be appreciated that media processing system 10 is comprised of a media transport phase or system 12 and an imaging phase or process 14. Media transport phase 12 facilitates the routing of media from a storage position into an imaging position and includes various subprocesses for the alignment of the media for both improved media alignment and improved media routing. Media transport phase or process 12 is further comprised of a media picking phase or process 16 for retrieving media from a stored position. Media transport process 12 is performed when a picking roller 18 retrieves media 20 from a stack of media 22. Picking roller 18 initiates the movement of media 20 down a media path, depicted generally as media path 24, toward imaging process 14.

During traversal of media path 24, media 20 is subjected to a media stiffness evaluation phase or process 26 in order to determine a relative stiffness associated with the media. Knowledge about a media's stiffness allows modifications in subsequent processing steps. Media stiffness evaluation phase 26, while more exhaustively described in subsequent figures, generally provides an environment wherein media 20' is pulled along the media path by rollers or other motional devices 28. In order to provide adjustments in response to the media stiffness, a media stiffness evaluation phase facilitates the free suspension of one end of the media, thereby allowing the suspended end to deflect or sag. As illustrated, rollers 28 provide a fulcrum for media 20' to cantilever or sag into the field of view of a stiffness sensor 30. Media 20', while in the sensory field of stiffness sensor 30, undergoes a reading by stiffness sensor 30 corresponding to a stiffness factor associated with media 20'. Process control signals are then generated by stiffness sensor 30 and sent to subsequent media processes for adjustment and modification as needed. It should be appreciated that gravity is employed as the deflecting forces; however, other forces may also be applied as the deflecting force and are contemplated to be within the scope of the present invention.

Media realignment phase 32 is a subsequent phase in media transport phase 12 wherein media 20" moves into realignment through the removal of skew of media 20" in relationship to registration rollers 34. Skew is removed from media 20" by the generation of a buckle in the media which occurs when rollers 36 continue advancing the trailing edge of media 20" while the leading edge of media 20" encounters the stopped registration rollers 34. In the present invention, sensor information derived from stiffness sensor 30 is utilized to control the amount of force applied by rollers 36 on media 20", thus preventing any further exacerbation of the skew or misalignment of the media in the media path due to an inappropriate amount of force being applied by rollers 36 to media 20". Once skew has been removed and alignment of the media has been improved, media 20'" is thereafter presented to imaging process 14 for further processing. Imaging of media 20 is improved because of the enhanced alignment of the media with the imaging process.

Figure 2A:
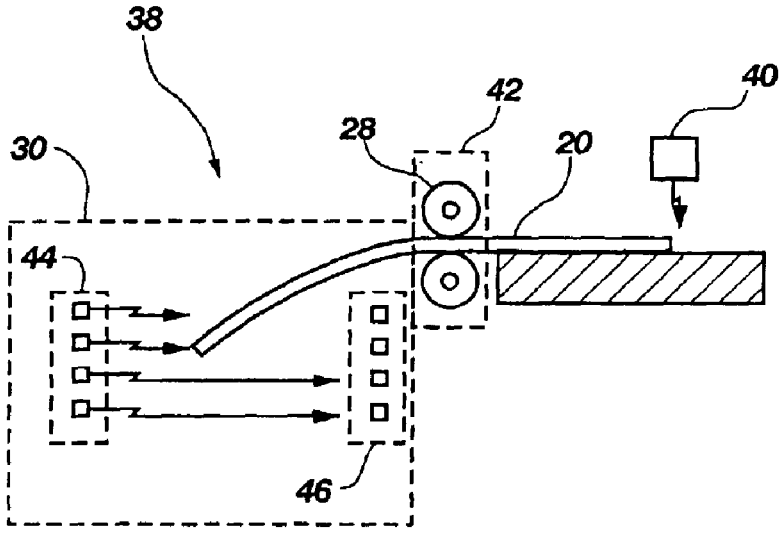
FIG. 2A is a diagram of a media stiffness measuring apparatus, in accordance with an embodiment of the present invention.

FIG. 2A illustrates a static measurement embodiment of media stiffness measuring apparatus 38, in accordance with an embodiment of the present invention. Media stiffness measuring apparatus 38 measures a deflection or sag of media 20 which corresponds to a stiffness characteristic of media 20. In order to measure a consistent deflection, media 20 is aligned in a cantilever fashion wherein a predetermined length and end of the media cantilevers into a field of view of a media stiffness sensor 30. To facilitate the cantilever configuration, a media cantilever length sensor 40 signals the proper extension of the cantilevered end of media 20. Rollers 28 facilitate both the mobility of media 20 as well as provide a cantilever pivot 42 which forms the fulcrum for the deflection or sagging of media 20 into the sensory field of view of media stiffness sensor 30.

Figure 2B:
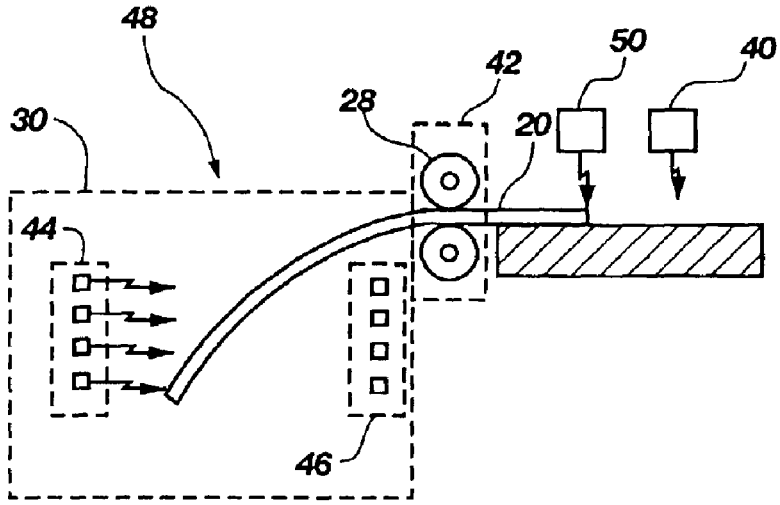
FIG. 2B is a diagram of an alternate embodiment of a media stiffness apparatus in accordance with an embodiment of the present invention.

Media stiffness sensor 30 is comprised of sensors for detecting the presence of media 20 and for quantifying the amount of deflection associated with the stiffness of media 20. FIG. 2A depicts sensor elements, namely transmitters 44 and receivers 46, which are arranged in a generally parallel configuration, for detecting intrusion between the respective and corresponding transmitters and receivers. By way of example, transmitter and receiver pairs 44, 46 may be comprised of optical sensor arrays configured as interrupter sensors responsive to an interruptive blockage between transmitters and receivers or may be further comprised of electromagnetic, acoustic or other mechanical sensors. While FIGS. 2A and 2B depict a particular orientation of the transmitter and receiver pairs, the illustration is merely exemplary and other orientations are also contemplated within the scope of the present invention. It should be apparent in the illustration that the quantity of sensory elements depicted may be further augmented to enhance the gradations of the stiffness measurements.

FIG. 2B illustrates an alternative embodiment depicted as media stiffness measuring apparatus 48 which may be implemented either to measure media deflection during a continuous motion of media 20 through the respective sensor elements 44 and 46 of media stiffness sensor 30 or as a discrete series of measurements. FIG. 2B depicts an additional length sensor 50 which detects the enhanced cantilever length for correlation with the corresponding deflection quantity exhibited within media stiffness sensor 30. In addition to being implemented as a continuous motion sensor, apparatus 48 may also be implemented in a discrete fashion wherein media 20 extends into stiffness sensor 30 a fixed length as defined by length sensor 50 for the taking of a first measurement by stiffness sensor 30 and then moved to a second position as measured by media length sensor 40 for designating a second media deflection quantity within stiffness sensor 30. In such an embodiment, both deflection measurements may then be processed in order to determine a specific type of media corresponding to the measured stiffness values.

Figure 3:
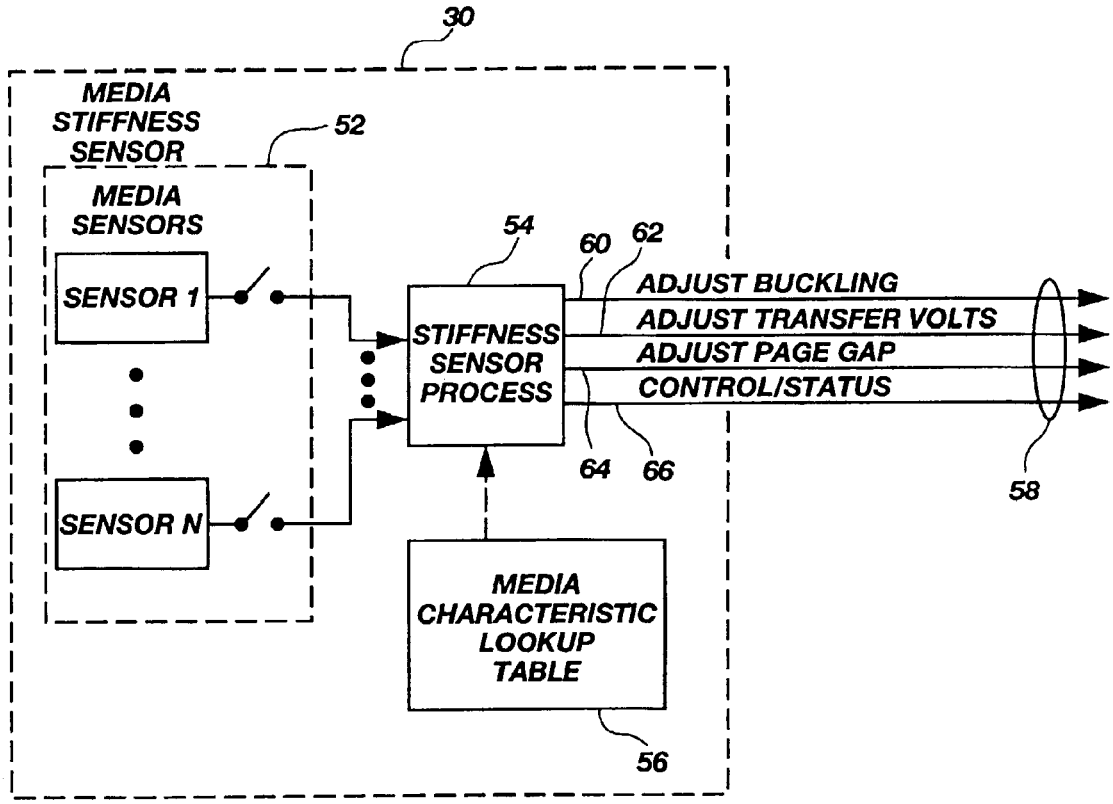
FIG. 3 is a functional block diagram of a media stiffness sensor, in accordance with an embodiment of the present invention.
Figures 4, 5:
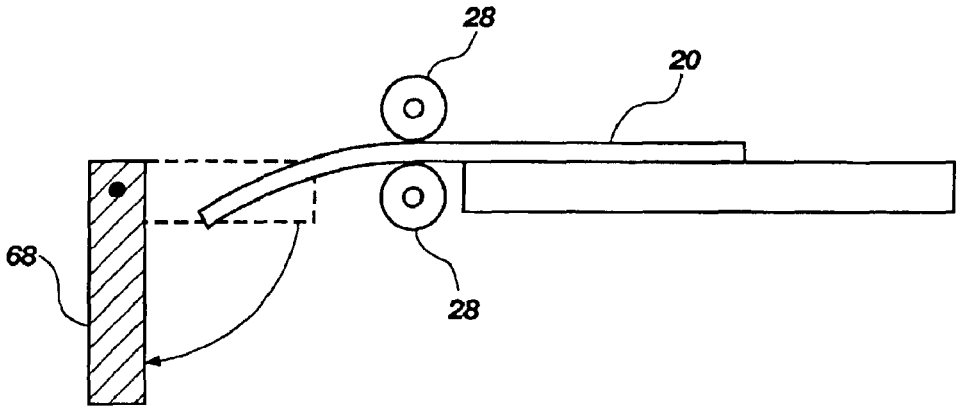
FIG. 4 illustrates a paper characteristic lookup table used in the practice of an embodiment of the present invention.
FIG. 5 illustrates a mechanical arrangement of a cantilevering-support portion of a media stiffness measuring device, in accordance with an embodiment of the present invention.

FIG. 3 illustrates a functional block diagram of media stiffness sensor 30, in accordance with the present invention. Stiffness sensor 30 includes media sensors 52, which were illustrated in FIGS. 2A and B as transmitters 44 and receivers 46. While a series of discrete sensors is illustrated, an integrated sensor capable of gradation outputs is also contemplated. The outputs associated with media sensors 52 are converted from a quantity of deflection measurements into status and control signals by stiffness sensor processor 54. In stiffness sensor processor 54, the stiffness of the media is calculated, in one embodiment, through the utilization of a media characteristic lookup table 56 which is exemplarily illustrated in FIG. 4. FIG. 4 illustrates a table indexed by a quantified media deflection amount that correlates to specific media types and characteristics. Yet another exemplary field includes adjustments to processes including transport and imaging processes in response to the media stiffness. It should be appreciated that various methods of calculating adjustments from measured stiffnesses may be contemplated and are within the scope of the present invention.

FIG. 3 further illustrates adjustment or status signals 58 resulting from the processing of the sensor data. Adjustment signals 58 provide a range of control which may be used to modify or adjust the transport process as well as the imaging process. With regard to the transport process, for example, it is advantageous to adjust the rollers associated with the buckling profile as described earlier. By way of example, a control signal 60 adjusts the roller rotation associated with buckling the media to remove the skew associated with the media in the media path according to the measured stiffness of the media. For example, stiffer media tends to retain its rigidity during the buckling process and may therefore wedge past the stopped registration rollers, resulting in an undesirable advancement of the media in the media path. Additional signals, such as control signal 62, may adjust other processes such as the transfer voltage associated with imaging processes. Likewise, adjustment of page gaps may also be desirably controlled by a control signal 64 with other process control and status signals illustrated generally as signal 66.

Other processing modifications in addition to buckling modifications also result in improved performance by a media processing system. Some examples of other parameters that can be monitored and adjusted in response to the determination of the media thickness include: fuser temperature modifications in response to different media types; fuser pressure modification also in response to different media types; paper path roller pressure adjustments for optimal performance since thicker media tends to slip more in the paper path, especially when turning corners; output bin routing for stiff media types that do not lend themselves to turning corners inside the paper path; roller wear monitoring by tracking the quantities of various types of media that have been processed by the system; stapling capabilities can be better tracked since the quantity of sheets to be stapled can be determined according to the media thickness; and various other parameters that may be altered based on the media thickness.

FIG. 5 illustrates one mechanical implementation for facilitating the cantilevering of media for measurement of media stiffness by stiffness sensor 30. In FIG. 5, rollers 28 provide a cantilevering point for media 20 with a portion of the media path, illustrated generally as cantilever support 68 being rotatable to an unsupporting position to allow media 20 to deflect into the sensory field.

Figure 6A:
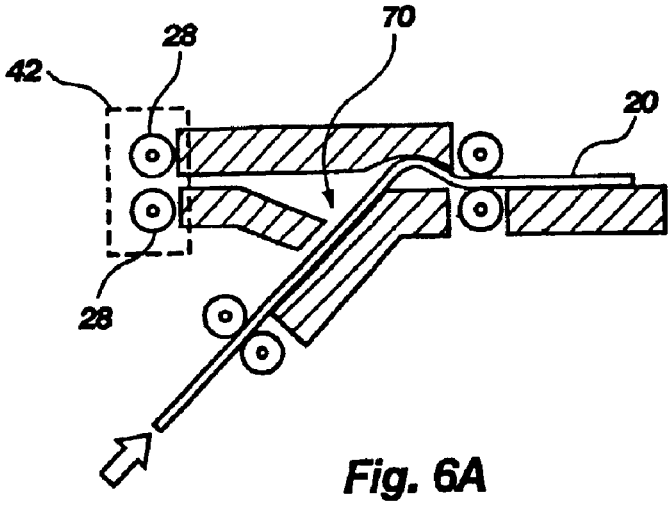
FIGS. 6A–6C illustrate another mechanical implementation of a cantilevering-support portion of a media stiffness measuring device, in accordance with another embodiment of the present invention.
Figure 6B:
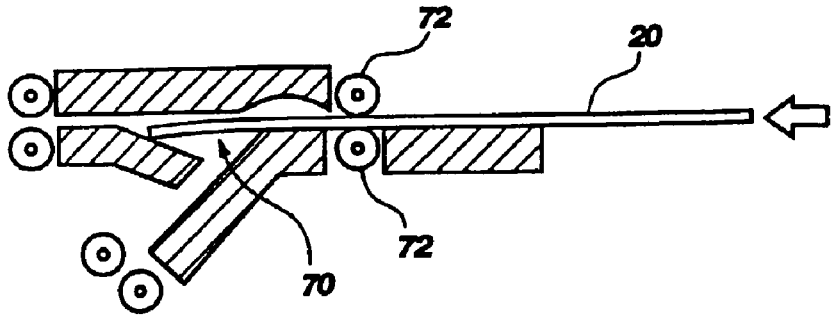
Figure 6C:
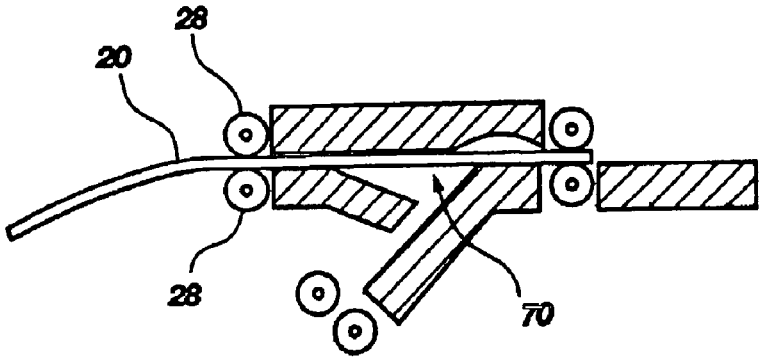

Similarly, FIGS. 6A, B and C illustrate another mechanical implementation for facilitating the cantilevering action for measuring the stiffness of media, in accordance with an embodiment of the present invention. In FIGS. 6A–C, media 20 is routed through a series of mechanical channels having routing support structure associated therewith, generally illustrated as cantilever channels 70. FIG. 6A illustrates the forwarding of media 20 into the cantilever channel 70 in a forward direction for alignment with cantilever point 42 and extension thereover.

FIG. 6B illustrates reversing of media 20 by transfer rollers 72 into another channeled portion of cantilever channel 70 for extension into a cantilever cavity having sensors therein. While FIG. 6B illustrates static channel profiles, dynamic channel profiles are also contemplated, including mechanically actuated portions for guiding media 20 into position for evaluation by stiffness sensor 30.

FIG. 6C illustrates media 20 coming to rest in an extended or cantilevered position extending from cantilever point 42, namely rollers 28, into a sensor region, not shown. The present invention also contemplates a cantilever point 42 that does not comprise rollers but rather is comprised of channel profiles alone or in combination with rollers.

While two typical embodiments for facilitating the cantilever action of media 20 into a sensory field or region have been illustrated, it is appreciated that other embodiments are also contemplated which facilitate the extension of media into a sensor region and are also contemplated to be within the scope of the present invention.

Figure 7:
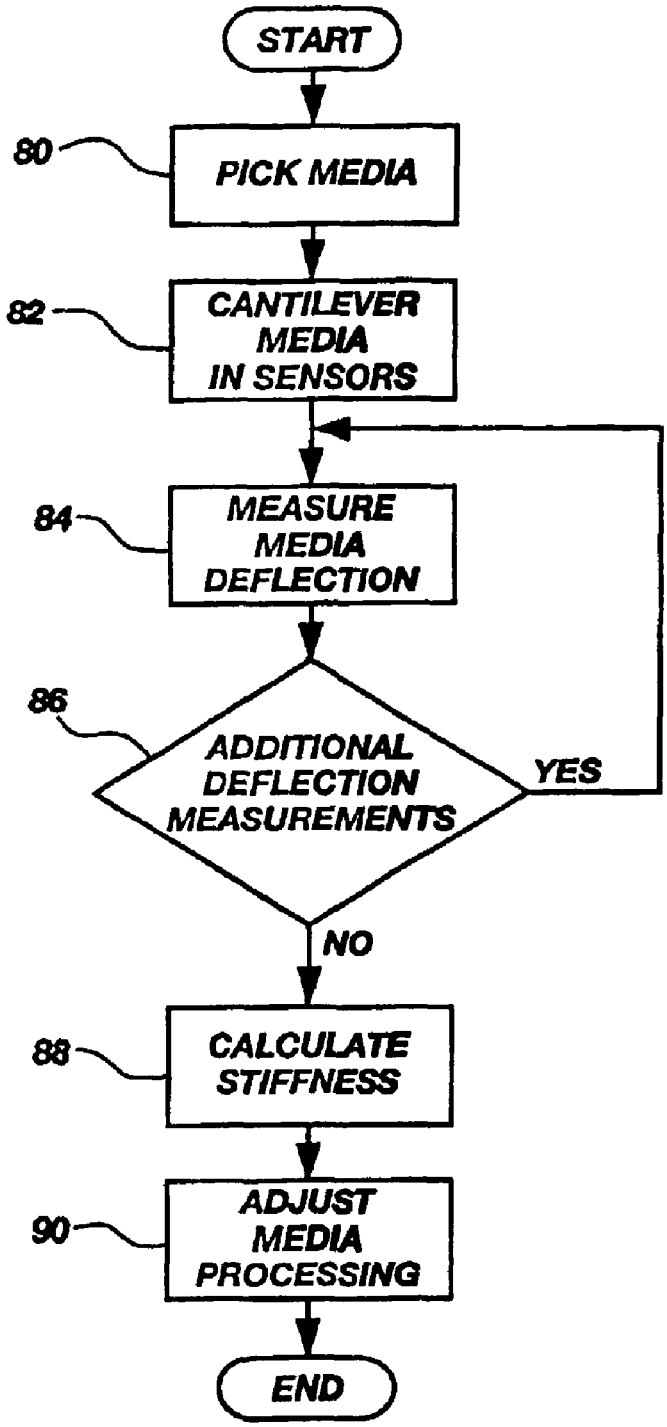
FIG. 7 illustrates a flow chart for measuring media stiffness and making adjustments to a media processing system, in accordance with an embodiment of the present invention.

FIG. 7 is a flow chart illustrating processing within a media transport process or system, in accordance with the present invention. It should be recalled that the media transport process aligns the media and may further identify adjustments to the imaging process for media 20. In a step 80, media 20 is picked from a tray or other media stack as introduced previously in FIG. 1. Picking may occur using rollers, vacuum, or otherwise for removal of a single sheet of media. Upon completion of picking of the media, a step 82, using one of several methods, cantilevers a first, namely a cantilevered, end of the media into the media stiffness sensors for measurement of an amount of deflection. A step 84 measures the quantity of deflection in the media, in one embodiment through the use of a series of interrupter sensors. As described above, other sensor arrangements are further contemplated, including electromagnetic, acoustic, mechanical and image processing.

An optional query step 86 facilitates multiple measurements of the media deflection as opposed to a single measurement. If multiple measurements are implemented, then step 84 is repeated for the gathering of subsequent deflection measurements. Otherwise, query step 86 is either bypassed or, upon the completion of the desired quantity of samples, processing passes to step 88 wherein the stiffness is calculated. As briefly introduced above, stiffnesses are calculated from the quantity of sensors triggered by the media deflection. Using the measured media stiffness, additional media characteristics and identities may be determined by referencing a lookup table that correlates media stiffness to unique media types. Characteristics such as surface roughness, grain orientation and others can be determined to optimize the imaging process.

In a step 90, control signals are generated for adjusting the media processing. Such signals may include roller force as applied by buckle rollers 36 including the amount of rotation of the buckle rollers for use in forming a media buckle. Additional control and status signals, such as signals 58 of FIG. 3, may be generated for control of both the media transport system 12 (FIG. 1) and imaging system 14 (FIG. 1).

Although preferred embodiments of the invention have been illustrated and described, various alternatives, modifications, and equivalents may be used. Therefore, the foregoing description should not be taken as limiting the scope of the invention which is defined by the appended claims.

What is claimed is:

1. In a media processing system, a media stiffness sensor, comprising:

a plurality of media sensors responsive to deflection of media extending into a field of view of said plurality of media sensors, said media having a cantilevered end for extending into said field of view of said plurality of media sensors to generate signals representative of a media deflection output; and a stiffness sensor processor, operably coupled to said media deflection output of said plurality of media sensors to generate adjustments to said media processing system.

2. The media stiffness sensor, as recited in claim 1, further comprising a lookup table operably referenceable by said stiffness sensor processor, said lookup table including tabular data correlating said media deflection output and said adjustments.

3. The media stiffness sensor, as recited in claim 1, wherein said plurality of media sensors are interrupter sensors.

4. The media stiffness sensor, as recited in claim 1, wherein said adjustments comprise control signals for adjusting a media buckling profile in response to said media deflection output.

5. A media stiffness measuring apparatus, comprising:

a cantilever pivot about which to extend media, said media having a cantilevered end for extending into a field of view of a plurality of sensors to generate a media deflection output; and a media stiffness sensor including:

a plurality of media sensors responsive to deflection of media extending into said field of view of said plurality of media sensors; and a stiffness sensor processor, operably coupled to said media deflection output of said plurality of media sensors, to generate adjustments to said stiffness measuring apparatus.

6. The media stiffness measuring apparatus, as recited in claim 5, further comprising a media cantilever length sensor for measuring a length of said cantilevered end of said media.

7. The media stiffness measuring apparatus, as recited in claim 5, wherein said media stiffness sensor further comprises a lookup table operably referenceable by said stiffness sensor processor, said lookup table including tabular data correlating said media deflection output and said adjustments.

8. The media stiffness measuring apparatus, as recited in claim 5, wherein said plurality of media sensors are interrupter sensors.

9. The media stiffness measuring apparatus, as recited in claim 5, wherein said adjustments comprise control signals for adjusting a media buckling profile in response to said media deflection output.

10. In a media processing system, a media transport system, comprising:

a media stiffness measuring apparatus for measuring stiffness of media passing through a media path of said media processing system, said media stiffness measuring apparatus comprising:

a cantilever pivot about which to extend media, said media having a cantilevered end for extending into a field of view of a plurality of sensors to generate a media deflection output; and a media stiffness sensor including:

a plurality of media sensors responsive to deflection of media extending into said field of view of said plurality of media sensors; and a stiffness sensor processor, operably coupled to said media deflection output of said plurality of media sensors, to generate adjustments to said media processing system; and a media realignment apparatus for modifying a buckle in said media according to said adjustments of said stiffness sensor process.

11. The media transport system, as recited in claim 10, wherein said media stiffness sensor further comprises a media cantilever length sensor for measuring a length of said cantilevered end of said media.

12. The media transport system, as recited in claim 10, wherein said media stiffness sensor further comprises a lookup table operably referenceable by said stiffness sensor processor, said lookup table including tabular data correlating said media deflection output and said adjustments.

13. The media transport system, as recited in claim 10, wherein said plurality of media sensors are interrupter sensors.

14. The media transport system, as recited in claim 10, wherein said adjustments comprise control signals for adjusting a media buckling profile in response to said media deflection output.

15. A method for measuring stiffness of media, comprising: cantilevering a cantilevered end of said media into a field of view of a media stiffness sensor; measuring an amount of deflection of said cantilevered end of said media; and calculating a stiffness measurement from said amount of said deflection.

16. The method, as recited in claim 15, wherein said cantilevering comprises:

measuring a length of said media for cantilevering; and placing the measured portion of said media for cantilevering in proximity of said media stiffness sensor.

17. The method, as recited in claim 16, wherein said placing said length of said media in proximity of said media stiffness sensor further comprises removing support for said cantilevered end of said media, thereby allowing said media to deflect in said field of view of said media stiffness sensor.

18. The method, as recited in claim 15, wherein said measuring comprises for a plurality of times, measuring an amount of deflection of said cantilevered end of said media for a corresponding plurality of different lengths of said media for cantilevering.

19. In a media processing system, a method for realigning media, comprising:

measuring stiffness of said media; and altering buckling of said media in response to said stiffness of said media.

20. The method, as recited in claim 19, wherein said measuring stiffness of said media comprises:

cantilevering a cantilevered end of said media into a media stiffness sensor;

measuring an amount of deflection of said cantilevered end of said media; and calculating a stiffness measurement from said amount of said deflection.

* * * * *